US007244145B2

(12) United States Patent
Johnsen et al.

(10) Patent No.: US 7,244,145 B2
(45) **Date of Patent: *Jul. 17, 2007**

(54) COAXIAL CABLE-Y SPLITTER ASSEMBLY WITH TRANSVERSE OPENING

(75) Inventors: David J. Johnsen, New Hope, MN (US); Jim Dewey, Plymouth, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/489,057

(22) Filed: Jul. 18, 2006

(65) Prior Publication Data

US 2006/0258211 A1 Nov. 16, 2006

Related U.S. Application Data

(63) Continuation of application No. 10/809,666, filed on Mar. 25, 2004, now Pat. No. 7,086,898.

(51) Int. Cl.
*H01R 9/05* (2006.01)
*H01R 24/00* (2006.01)
*H01R 25/00* (2006.01)

(52) U.S. Cl. ..... 439/579; 439/584; 439/638

(58) Field of Classification Search ..... 439/579, 439/584, 638, 580, 585, 502; 174/74 R
See application file for complete search history.

(56) References Cited

U.S. PATENT DOCUMENTS 4,738,009 A 4/1988 Down et al.
4,773,879 A 9/1988 Pauza
5,030,122 A 7/1991 Birch et al.
5,387,116 A 2/1995 Wang (Continued)

OTHER PUBLICATIONS

Trompeter Electronics Inc., p. 14, undated, from a 1991 Product Catalog.

(Continued)

*Primary Examiner*—Chandrika Prasad
(74) *Attorney, Agent, or Firm*—Merchant & Gould P.C.

(57) ABSTRACT

A coaxial cable signal splitter with first, second and third connector ends, each adapted to mate with a coaxial cable connector. The first connector end is integral with a splitter body. The second and third connector ends are connected to the body by a pair of coaxial cables. Each connector end includes a center conductor mounted within a coaxially arranged conductive outer shell conductor. The splitter body includes the first connector end and an opposing arrangement for connecting the pair of cables to the body. The splitter body includes a transverse opening between the first connector end and the cable mounting arrangement, the opening extending through the body and having opposing open sides. Within the opening, the center conductor of the first connector end is electrically connected with the center conductors of the second and third connector ends. The center conductor of the first connector end extends within the conductive outer shell of the first connector end and within the opening of the body. The center conductor of each of the pair of coaxial cables extend within the opening of the body and are electrically connected to the center conductor of the first connector end, and each of the conductive outer shell connectors electrically connected to the other conductive outer shells.

20 Claims, 8 Drawing Sheets

U.S. PATENT DOCUMENTS

| | | | |
|---|---|---|---|
| 5,503,566 | A | 4/1996 | Wang |
| 5,702,261 | A | 12/1997 | Wang |
| 6,299,479 | B1 | 10/2001 | Tang |

OTHER PUBLICATIONS

Exhibits A and B, photographs of products manufactured by competitors (admitted as prior art as of Mar. 25, 2004).

Trompeter Electronics, Inc. data sheet, Drawing No. 1-0468, Jan. 2003.

Trompeter Electronics, Inc. data sheet, Drawing No. 105-1541, Mar. 1, 1994.

Trompeter Electronics, Inc. data sheet, Drawing No. 1-0252, Dec. 11, 1989.

Trompeter Electronics, Inc. data sheet, Drawing No. 105-0140, Jan. 22, 1992.

Trompeter Electronics, Inc. data sheet, Drawing No. 01-0494, Mar. 27, 2001.

COAXIAL CABLE-Y SPLITTER ASSEMBLY WITH TRANSVERSE OPENING

CROSS-REFERENCE TO RELATED APPLICATIONS

This application is a continuation of U.S. patent application Ser. No. 10/809,666, filed Mar. 25, 2004, now U.S. Pat. No. 7,086,898 the disclosure of which is hereby incorporated by reference.

TECHNICAL FIELD

The present invention generally relates to telecommunications cable assemblies and more specifically to a Y-splitter assembly and method for use with a coaxial cable.

BACKGROUND

Coaxial cables are often used for the transmission of telecommunications signals. At times, it is desirable to divide these signals. When such a signal is divided to permit a monitor function, only a small fraction of the signal is divided at a monitor tap. The bulk of the signal is transmitted without interruption and the small fraction is directed to a monitoring device or circuit to monitor the quality, quantity or content of the signal being transmitted. However, sometimes it is desirable to break the signal into two approximately equal portions. A Y-splitter is used to divide the signal from a first telecommunications cable into two second telecommunications cables and may provide a desired equal split of the signal or may direct more of the signal from the first cable into one of the two second cables and less of the signal to the other of the two second cables.

Improvements to current Y-splitters are desirable. Improvements to splitting of signals from a first cable into the second cables are desirable.

SUMMARY

The present invention relates generally to a coaxial cable signal splitter with first, second and third connector ends, each adapted to mate with a coaxial cable connector. The first connector end is integral with a splitter body. The second and third connector ends are connected to the body by a pair of coaxial cables. Each connector end includes a center conductor mounted within a coaxially arranged conductive outer shell conductor. The splitter body includes the first connector end and an opposing arrangement for connecting the pair of cables to the body. The splitter body includes a transverse opening between the first connector end and the cable mounting arrangement, the opening extending through the body and having opposing open sides. Within the opening, the center conductor of the first connector end is electrically connected with the center conductors of the second and third connector ends. The center conductor of the first connector end extends within the conductive outer shell of the first connector end and within the opening of the body. The center conductor of each of the pair of coaxial cables extend within the opening of the body and are electrically connected to the center conductor of the first connector end, and each of the conductive outer shell connectors electrically connected to the other conductive outer shells.

A splitter body including a first end including an integral electrically conductive outer shell of a coaxial cable connector and a opposite second end with a pair of electrically conductive crimp extensions for mounting a pair of coaxial cables. The body includes a central opening extending transversely through the body between the first and second ends. The first and second ends are connected by a pair of side walls on either side of the central opening, and the side walls electrically connect the outer shell and the crimp extensions. The first end includes an opening extending from the outer shell into the central opening and sized to receive a center conductor mounted within a center conductor insulator. Each of the crimp extensions includes an opening extending through the crimp extensions into the central opening, the openings sized to receive a center conductor of one of the coaxial cable electrically isolated from the body. Each crimp extension also includes a textured outer surface. The central opening provides space for the center conductor of the first end to be electrically connected with the center conductors of the coaxial cables without electrically contacting the side walls.

The present invention further relates to a method of assembling a coaxial cable splitter including providing a splitter body with a first end defining a first cable connector end, and a second opposing end. The second end includes a first cable mounting arrangement and a second cable mounting arrangement. The splitter body defines a transverse opening extending through the body between the first and second ends of the splitter body. The first end and the cable mounting arrangements electrically connected to each other. A first center conductor is inserted within a first insulator and the first insulator and the first center conductor are positioned within the first end of the splitter body, with a rear end of the first center conductor extending within the transverse opening. A center conductor and a center conductor insulative jacket sheath of a first coaxial cable are inserted through the first cable mounting arrangement and into the transverse opening. A center conductor and a center conductor insulative jacket sheath of a second coaxial cable are inserted through the second cable mounting arrangement and into the transverse opening. A portion of each of the center conductors of the coaxial cables extending from the insulative jacket sheaths. The extended portion of each of the center conductors of the coaxial cables within the transverse opening are intertwined. The intertwined portions of the center conductors of the coaxial cables are positioned within a notch formed in the rear end of the center conductor of the first end to electrically connect the center conductors. An outer conductor of the first coaxial cable is electrically connected to first cable mounting arrangement and the first coaxial cable is crimped to the first cable mounting arrangement. An outer conductor of the second coaxial cable is electrically connected to the second cable mounting arrangement and crimping the second coaxial cable is crimped to the second cable mounting arrangement.

The present invention relates still further to a coaxial cable signal splitter with first, second and third coaxial connectors. The first coaxial connector includes a first conductive body. The first conductive body includes a hollow first end defining a coaxial connector end for mating with a first mating coaxial connector. The first conductive body also includes an opposite end defining two parallel hollow crimp extensions, the opposite end spaced from the first end along a longitudinal axis of the first conductive body. The first conductive body further includes an intermediate portion defining a transverse opening extending through the first conductive body transverse to the longitudinal axis. The intermediate portion includes first and second side walls on opposite sides of the transverse opening and spaced on opposite sides of the longitudinal axis. The intermediate portion also includes first and second end walls on opposite ends of the traverse opening and spaced from each other along the longitudinal axis.

The first conductive body further includes two conductive crimp sleeves, each one mounted over one of the crimp extensions. A first center conductor is positioned within the first end of the first conductive body. A first insulator electrically isolates the first center conductor from the first conductive body. A conductive bushing is positioned over the first conductive body and encloses the transverse opening.

The second coaxial connector includes a second conductive body, a second center conductor disposed within the second conductive body, and a second insulator electrically isolating the second center conductor from the second conductive body. The second coaxial connector defines a distal end for mating with a second mating coaxial connector. The third coaxial connector includes a third conductive body, a third center conductor disposed within the third conductive body, and a third insulator electrically isolating the third center conductor from the third conductive body. The third coaxial connector defines a distal end for mating with a third mating coaxial connector.

Two flexible coaxial cables extend between first and second opposite ends. Each coaxial cable includes an outer jacket, a ground shield inside the outer jacket, an inner jacket inside the ground shield, and a main signal center conductor inside the inner jacket. The ground shield and the main signal center conductor of each coaxial cable are connected at the first ends to the second and third coaxial connectors. The ground shields of the coaxial cables are each connected to one of the respective second and third conductive bodies. The main signal center conductors are each connected to one of the respective second and third center conductors. The ground shields of the coaxial cables at the second ends are each connected to one of the crimp extensions under one of the crimp sleeves. The main signal center conductors of the coaxial cables at the second ends extend through the crimp extensions and into the transverse opening. The main signal center conductors connect to the first center conductor within the transverse opening.

BRIEF DESCRIPTION OF THE DRAWINGS

The accompanying drawings, which are incorporated in and constitute a part of the description, illustrate several aspects of the invention and together with the detailed description, serve to explain the principles of the invention. A brief description of the drawings is as follows.

DETAILED DESCRIPTION

Reference will now be made in detail to exemplary aspects of the present invention which are illustrated in the accompanying drawings. Wherever possible, the same reference numbers will be used throughout the drawings to refer to the same or like parts.

Figures 1, 2, 3, 4:
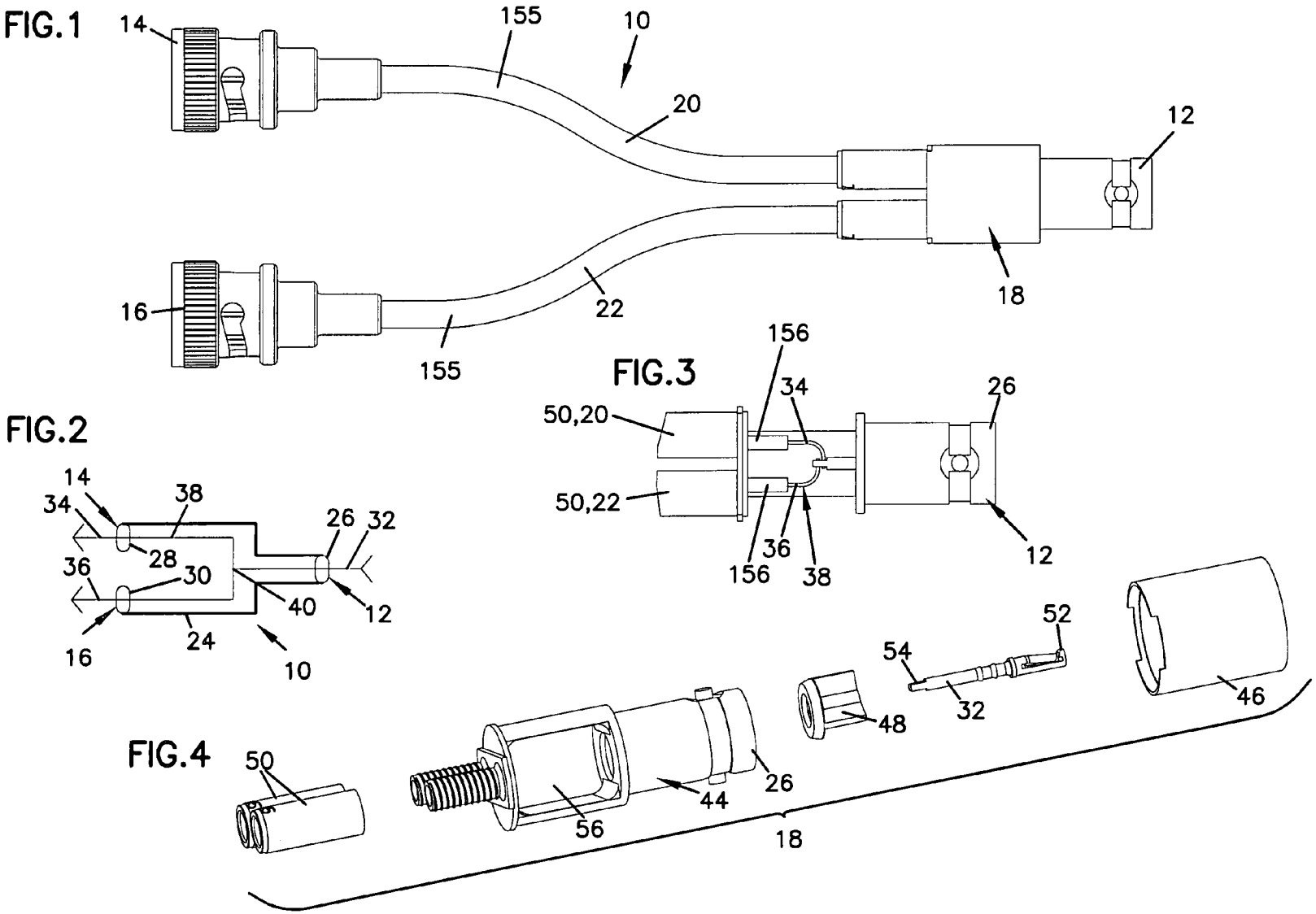
FIG. 1 is a top view of a coaxial cable Y-splitter according to the present invention.
FIG. 2 is a schematic of the Y-splitter of FIG. 1.
FIG. 3 is an enlarged view of one end of the Y-splitter of FIG. 1, with a protective bushing and one of the sides removed to show the interior of the end.
FIG. 4 is an exploded side view of the end of the Y-splitter of FIG. 3, with the two opposite cable ends removed.
Figure 6:
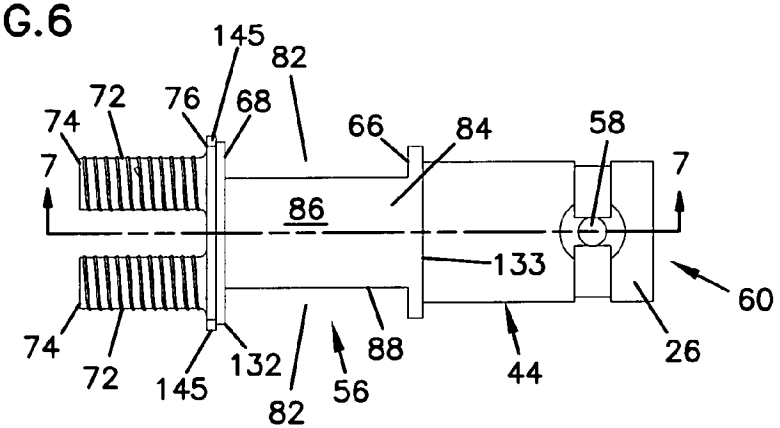
FIG. 6 is a top view of the body of the Y-splitter.
Figure 9:
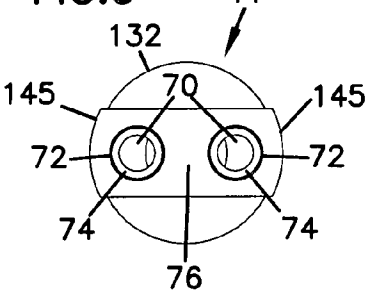
FIG. 9 is a second end view of the body of the Y-splitter.

Referring to FIG. 1, a coaxial cable Y-splitter or splitter 10 is shown, including an input coaxial connector end 12, a first output coaxial connector 14 and a second output coaxial connector end 16. Input end 12 is part of a splitter housing assembly 18 and the output ends 14 and 16 are connected to splitter housing assembly 18 by cables 20 and 22, respectively. As shown, input end 12 is a female coaxial connector and a pair of output ends 14 and 16 are male coaxial connectors. Ends 12, 14 and 16 are of the same format and end 12 could be mated to either of ends 14 or 16. Alternatively, ends 12, 14 and 16 could be of different combinations of genders and may also conform to incompatible coaxial connectors styles, formats or standards for coaxial cable connectors. The gender, style, format or standards to which the ends conform may be chosen as required for a particular installation or use requirement. Cables 20 and 22 are flexible coaxial electrical cables with coaxially arranged conductors. Other types and styles of flexible cables may be used so long as such alternative cables may be terminated using coaxial cable connectors.

FIG. 2 shows an electrical schematic diagram of splitter 10. Input end 12 and output ends 14 and 16 share a common ground 24. Common ground 24 is electrically connected to a conductive outer shell 26, 28 and 30, respectively, of each of the ends. If mating ends are connected to ends 12, 14 and 16, and these mating ends terminate coaxial cables, common ground 24 would provide electrical continuity for the shield conductor within the different coaxial cables. A center conductor 32 of end 12 is electrically connected to a center conductor 34 of end 14 and a center conductor 36 of end 16 by a circuit 38. Circuit 38 includes an electrical split 40 to separate portions of any electrical signals or impulses transmitted to center conductor 32 to center conductors 34 and 36. In the preferred embodiment, no other electrical devices or features are provided within splitter 10 which might serve to deliberately direct a greater or lesser portion of such a signal from end 12 to either end 14 or 16. Barring differences in internal resistance within wires and joints of circuit 38, any signal from center conductor 32 should be split evenly between center conductor 34 and 36. Alternatively, splitter 10 may be configured with some degree of resistance in circuit 38 between split 40 and either of center conductors 34 or 36. Such an alternative configuration would serve to direct more of the electrical signal from end 12 to one of the ends 14 or 16. The structure and elements of each of the ends will be described in further detail below.

Figure 26:
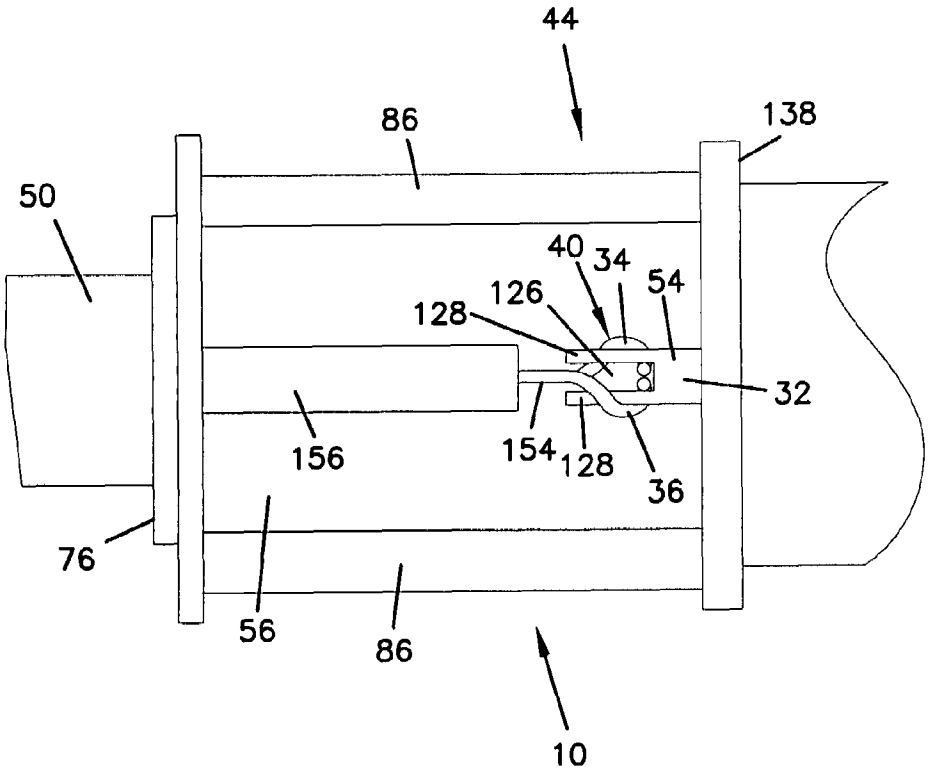
FIG. 26 is an enlarged side view of the end of the Y-splitter of FIG. 1, with the protective bushing removed.
Figure 30:
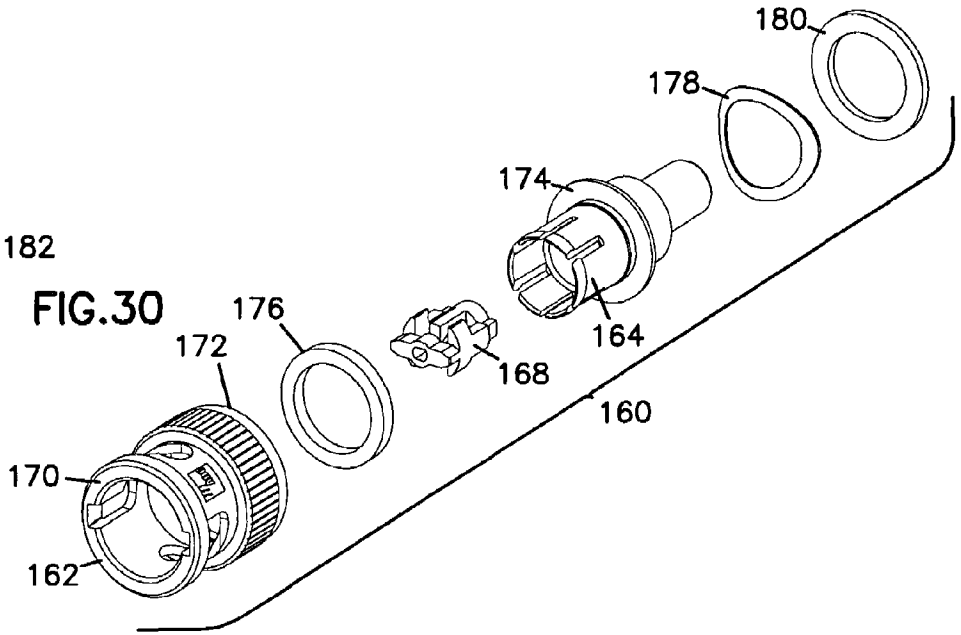
FIG. 30 is an exploded perspective view of the cable end coaxial connector of FIG. 28.
Figure 29:
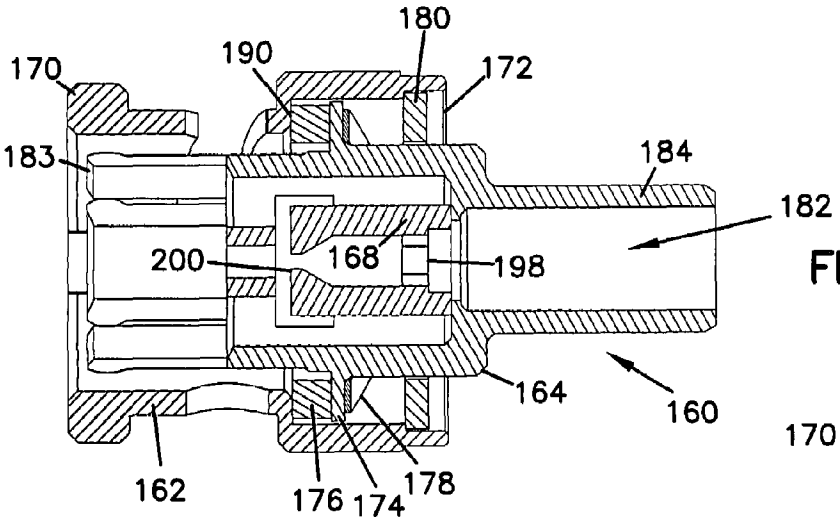
FIG. 29 is a side cross-sectional view of the cable end coaxial connector of FIG. 28.
Figure 31:
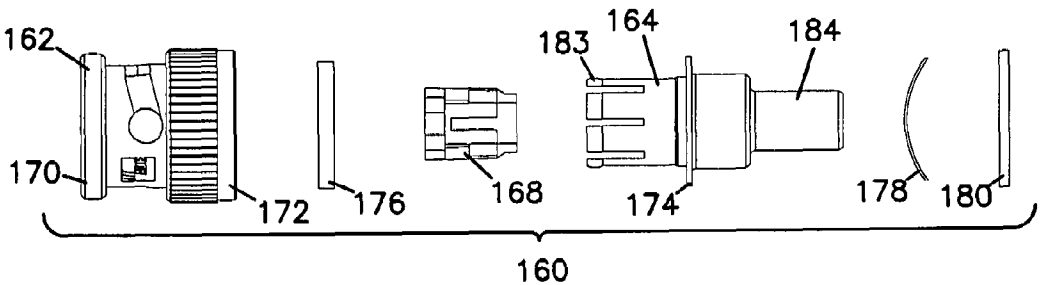
FIG. 31 is an exploded side view of the cable end coaxial connector of FIG. 28.
Figure 33:
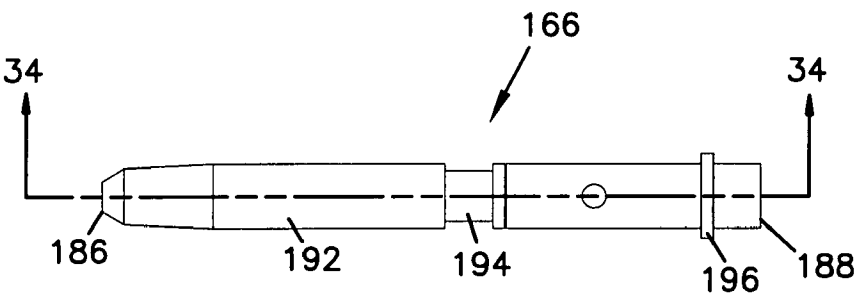
FIG. 33 is a top view of the center conductor of FIG. 32.
Figure 32:
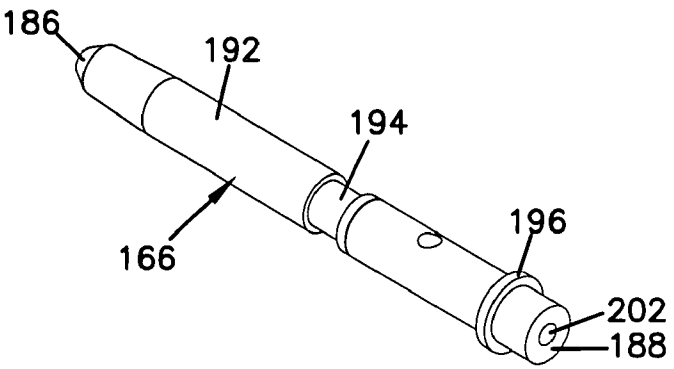
FIG. 32 is an exploded perspective view of a center conductor for mounting within the cable end coaxial connector of FIG. 28.
Figure 35:
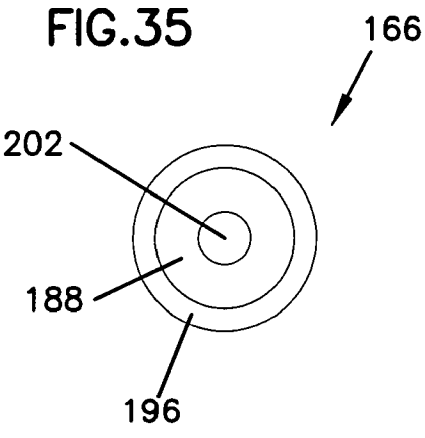
FIG. 35 is an end view of the center conductor of FIG. 32.
Figure 34:
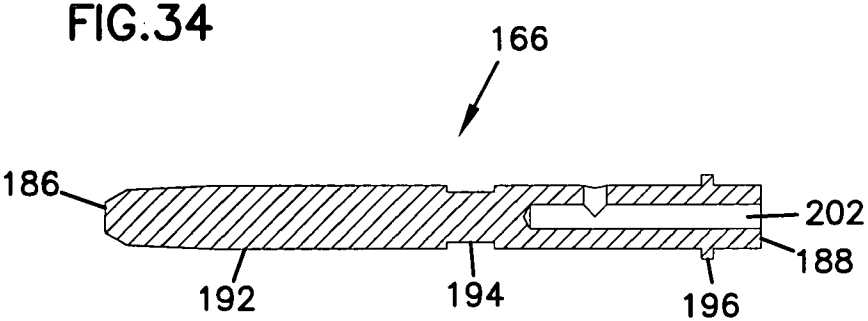
FIG. 34 is a side cross-sectional view of the center conductor, taken along line 34—34 in FIG. 33.

FIGS. 3 and 26 show a closer view of splitter housing assembly 18 of splitter 10 adjacent end 12, with a protective bushing 46 of housing assembly 18 removed to show electrical split 40 of center conductor circuit 38. Center conductors 34 and 36 extend from cables 20 and 22 into a body 44. Center conductors 34 and 36 of cables 20 and 22, respectively, are intertwined with each other. The intertwined center conductors 34 and 36 are positioned within a second end 54 of center conductor 32 of first end 12 and are soldered to form split 40. Second end 52 and split 40 are described in further detail below with regard to FIG. 26.

FIG. 4 shows an exploded view of housing assembly 18, including body 44, protective bushing 46, a center conductor insulator 48 and a pair of crimp sleeves 50. Center conductor 32 is mounted within center conductor insulator 48, which is in turn mounted within housing 42. A first end 52 of center conductor 32 extends within conductive outer shell 26 to form coaxial connector end 12. Opposite second end 54 of center conductor 32 extends within an opening 56 of housing 44 extends within an opening 56 of housing 44 and provides a location for electrical split 40 to be formed.

FIGS. 5 to 10 show body 44 in further detail, with opening 56 extending through body 44 and providing access to second end 54 of center conductor 32 to form electrical split 40. Conductive outer shell 26 includes a pair of opposing bayonets 58 to permit a mating coaxial connector to be releasably locked to first end 12. Conductive outer shell 26 also defines an opening 60 from an outer lip 64 into opening 56 through an first inner wall 66. Within opening 60 is an area 62 sized to receive and retain center conductor insulator 48 and position center conductor 32 with first end 52 positioned within conductive outer shell 26 and second end 54 within opening 56.

Figure 10:
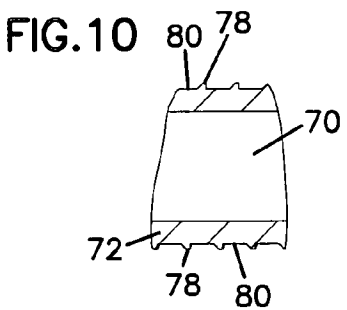
FIG. 10 is a partial cross-sectional view of a crimp shaft of the body of the Y-splitter.
Figure 8:
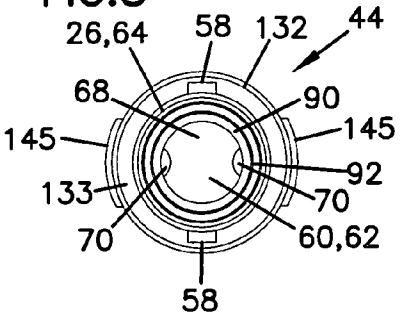
FIG. 8 is a first end view of the body of the Y-splitter.
Figure 5:
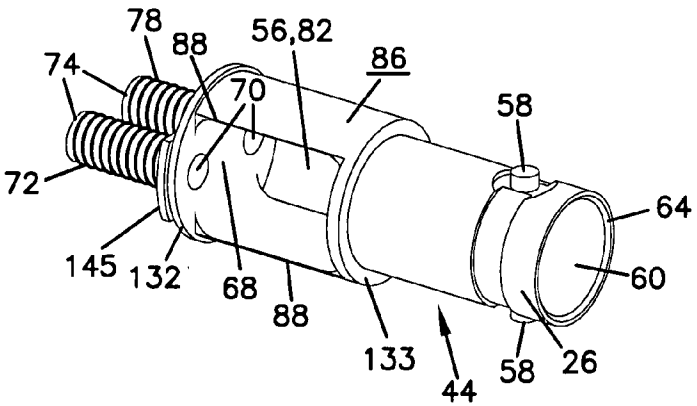
FIG. 5 is a side perspective view of the body of the end of the Y-splitter of FIG. 4.
Figure 7:
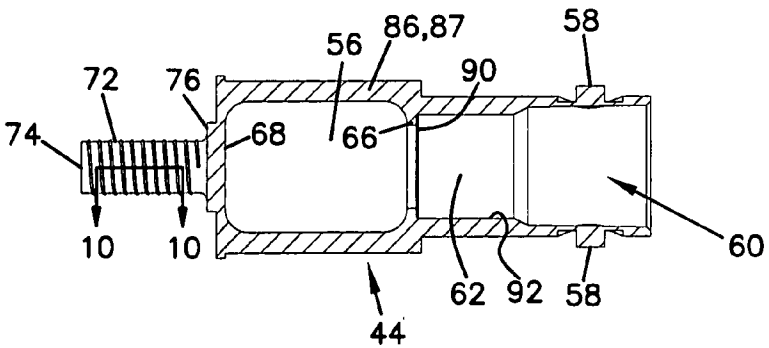
FIG. 7 is a cross-sectional side view of the body of the Y-splitter, taken along line 7—7 in FIG. 6.
Figure 13:
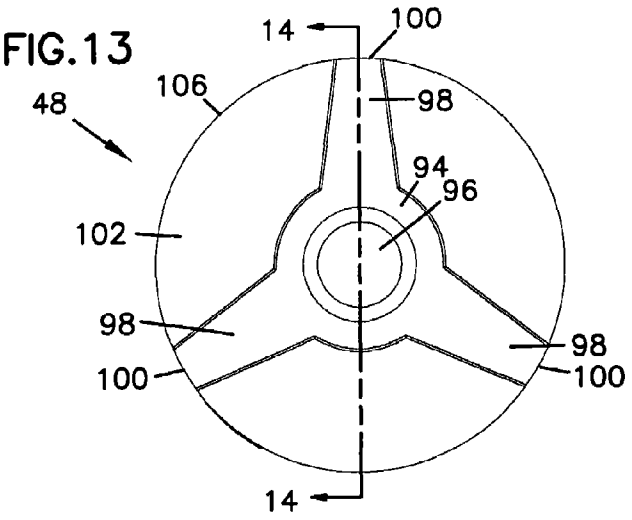
FIG. 13 is an end view of the center conductor insulator of FIG. 11.
Figure 14:
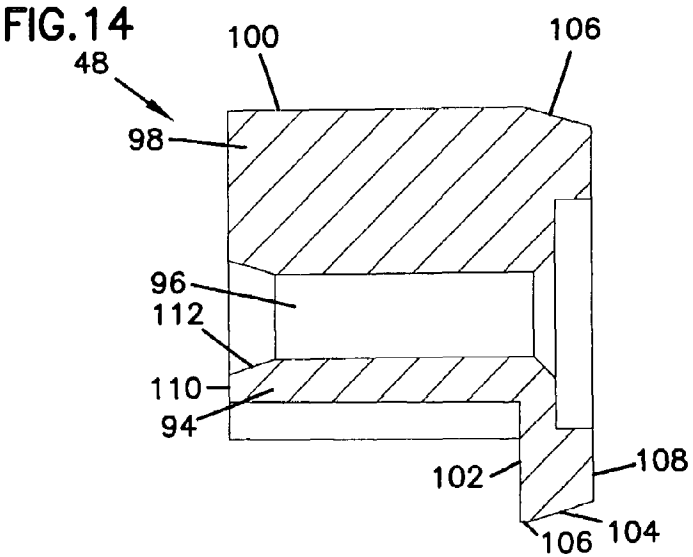
FIG. 14 is a cross-sectional view of the center conductor insulator, taken along line 14—14 in FIG. 13.
Figure 11:
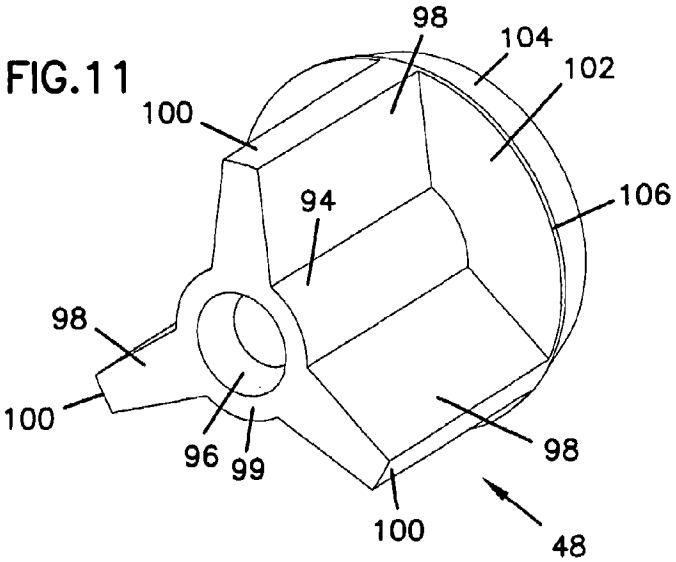
FIG. 11 is a perspective view of a center conductor insulator for insertion within the body of the Y-splitter.
Figure 12:
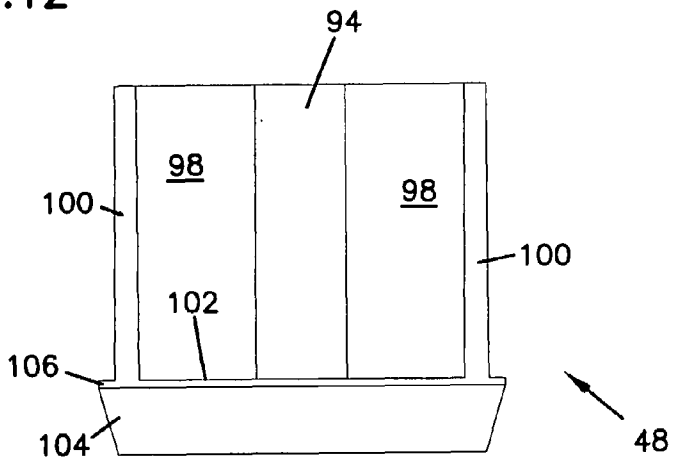
FIG. 12 is a side view of the center conductor insulator of FIG. 11.

Extending through a second opposing inner wall 68 of opening 56 is a pair of openings 70. A pair of crimp extensions 72 extend from an outer wall 76, opposite second inner wall 68, and extend each opening 70 from opening 56 to an outer lip 74. Openings 70 provide a path for cables 20 and 22 to connect to body 44 and extend into opening 56 to electrical split 44. Crimp extensions 72 may include spiral threads 78, as shown, on an outer surface 80 to provide greater mechanical strength to the connection of cables 20 and 22 to body 44, as shown in FIG. 10. Alternatively, other surface treatments or textures may be used on the outer surface of extensions 72, including, but not limited to, circumferential grooves or raised rings, molded or formed surface textures, applied surface treatments, or other roughening techniques. As a further alternative, no special surface treatment or structure may be provided on the outer surface of extensions 72.

Body 44 may be cast as a blank without openings 56, 60, and 70, and then the blank machined or otherwise configured to include the features shown and described above. Alternatively, body 44 could be machined from as a complete body from a piece of appropriate raw material, such as aluminum, brass, or other suitable, electrically conductive material. To provide access into opening 56 to form or repair electrical split 44, it is desirable that opening 56 extend through the width of body 44 with access provided into opening 56 through a pair of opposing sides 82. As shown, opening 56 is formed by milling or machining through an intermediate portion 84 of body 44. This creates a side wall 86 with a maximum thickness 87 along a centerline perpendicular to the direction of insertion of the milling or machining device and tapering in thickness to opposing edges 88 adjacent opposite sides 82. Other methods or techniques of forming body 44 may be used to create opening 56 and sides 82.

Within area 62 is an inner ledge 90 and an inner wall 92 which locate and position center conductor insulator 48 within body 44. Inner ledge 90 limits the depth to which center conductor insulator 48 may be inserted within opening 60 through conductive outer shell 26.

Center conductor insulator 48, shown in greater detail in FIGS. 11 to 14, includes a center shaft portion 94 defining a central opening 96 sized to receive center conductor 32. Extending from shaft portion 96 are a plurality of wings 98, each having an outer surface 100 which cooperate to define the outer diameter of center conductor insulator 48. Center conductor insulator 48 also includes a base 102 with a bottom surface 108 opposite wings 98 and transitioning through a taper 104 to a maximum diameter 106, which coincides with the outer diameter defined by outer surfaces 100 of wings 98. Taper 104 aids insertion of center conductor insulator 48 within opening 60 and into portion 62 so that bottom surface 108 is proximate inner ledge 90 and ledge 90 prevent further insertion within body 44. Center conductor 32 positioned within opening 96 would have first end 52 extending beyond a top surface 110 within conductive outer shell 26 and second end 54 extending from bottom surface 108 into opening 56 through first inner wall 66 of body 44, when center conductor insulator 48 is positioned within area 62 of opening 60. A taper 112 is provided from top surface 110 into opening 96 to aid the insertion of center conductor 32 within opening center conductor insulator 48. Adjacent taper 112 of opening 96 is an outer surface 99 of shaft portion 94.

Figure 15:
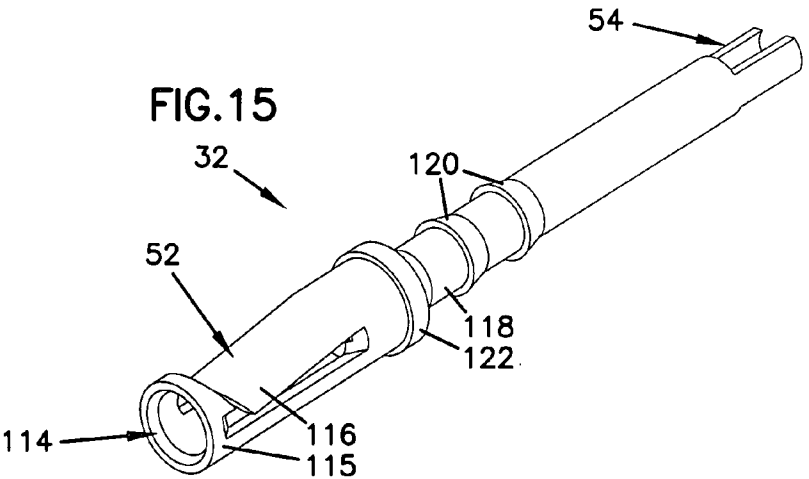
FIG. 15 is a perspective view of a center conductor for mounting within the center conductor insulator of FIG. 11.
Figure 16:
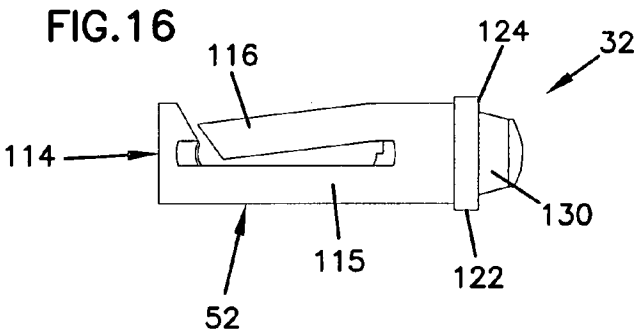
FIG. 16 is an enlarged side view of an end of the center conductor of FIG. 15.
Figure 17:
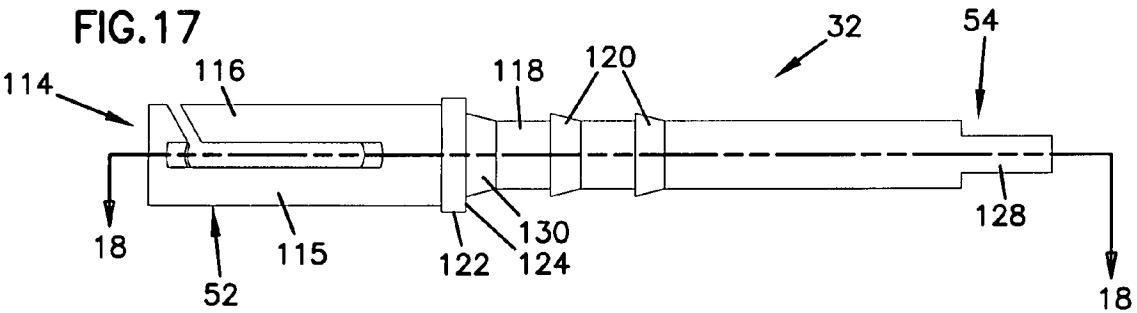
FIG. 17 is a side view of the center conductor of FIG. 15, prior to the displacement of the spring contact.
Figure 19:
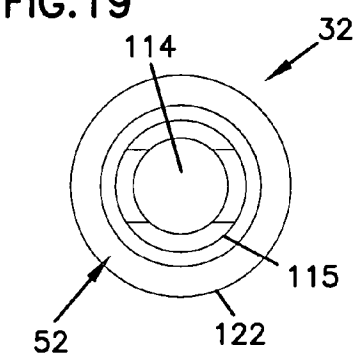
FIG. 19 is an end view of the center conductor of FIG. 15.
Figure 18:
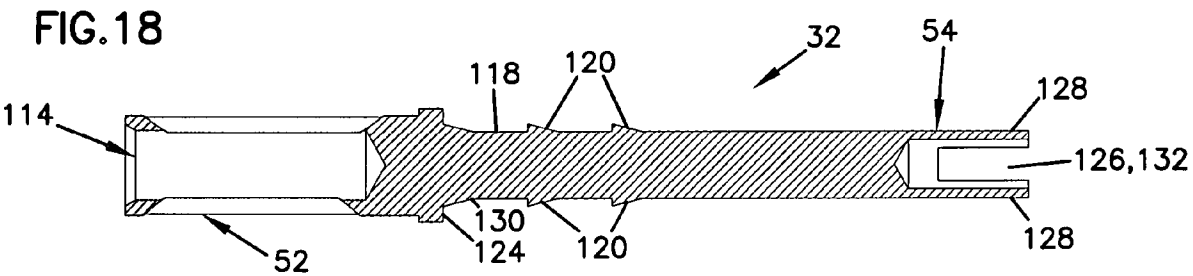
FIG. 18 is a cross-sectional view of the center conductor, taken along line 18—18 in FIG. 17.
Figure 22:
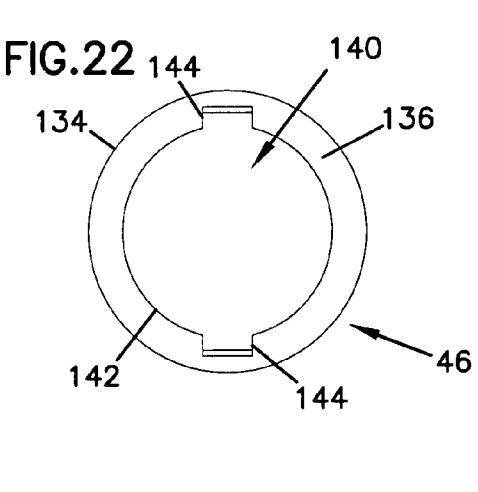
FIG. 22 is a first end view of the protective bushing of FIG. 20.
Figure 21:
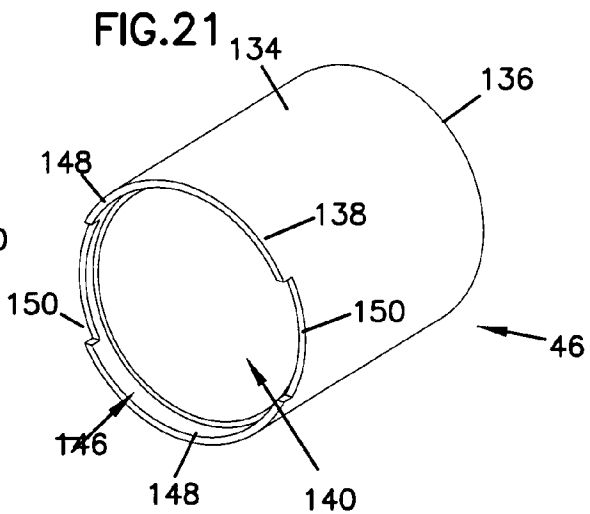
FIG. 21 is a second perspective view of the protective bushing of FIG. 20.
Figure 20:
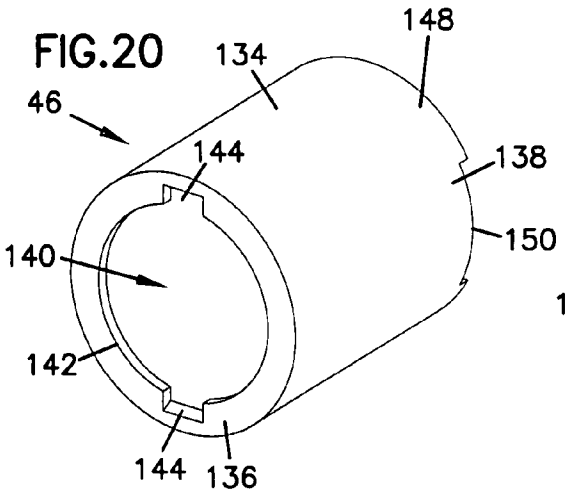
FIG. 20 is a first perspective view of the protective bushing of the Y-splitter of FIG. 1.
Figure 25:
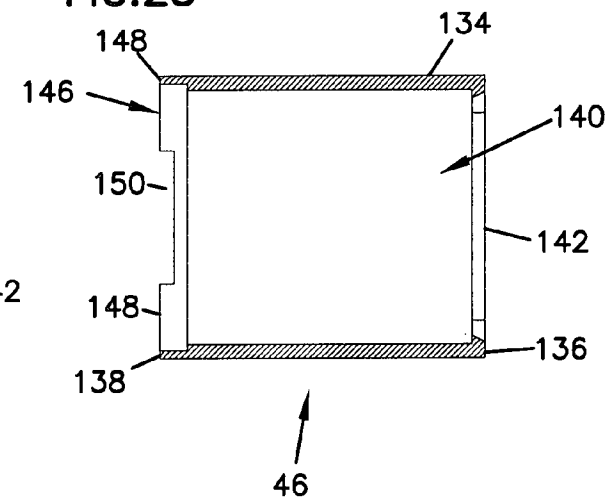
FIG. 25 is a second cross-sectional view of the protective bushing, taken along line 25—25 in FIG. 23.
Figure 24:
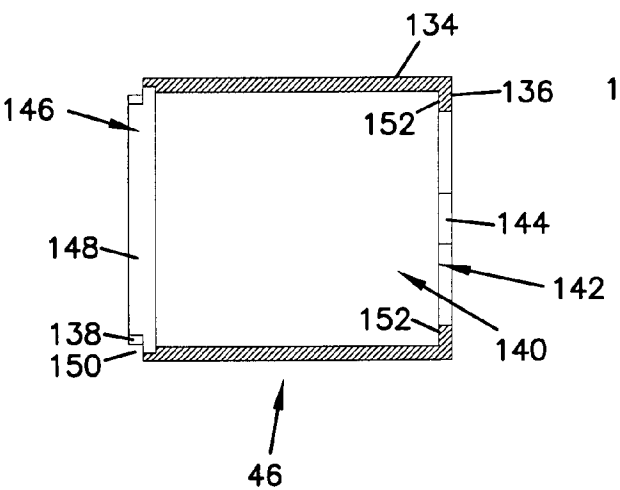
FIG. 24 is a first cross-sectional view of the protective bushing, taken along line 24—24 in FIG. 23.
Figure 23:
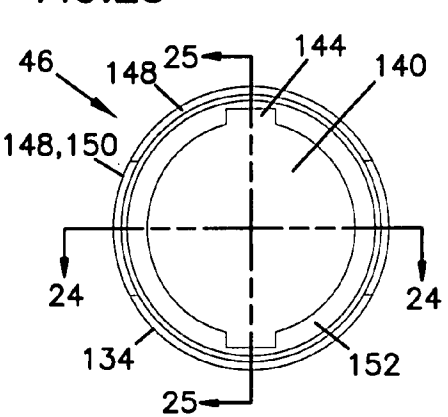
FIG. 23 is a second opposite end view of the protective bushing of FIG. 20.
Figure 27:
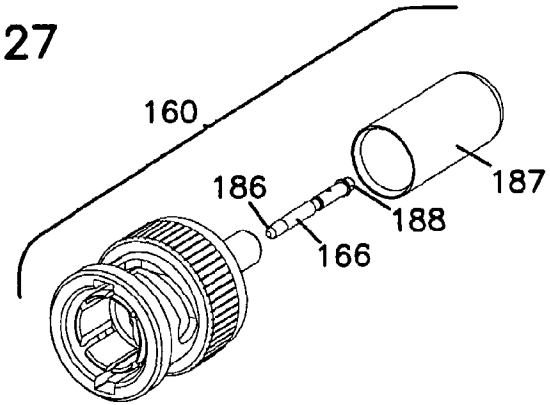
FIG. 27 is an exploded perspective view of a cable end coaxial connector assembly mounted at the end of the cables of the Y-splitter of FIG. 1.
Figure 28:
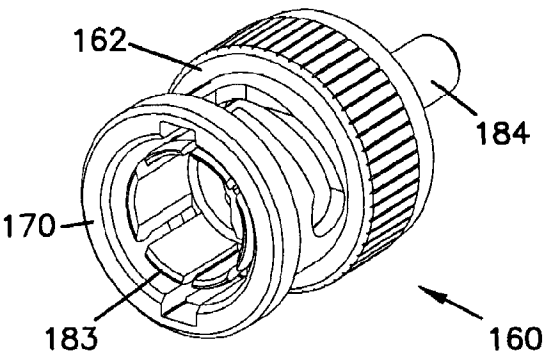
FIG. 28 is a perspective view of the cable end coaxial connector of FIG. 27, without the crimp sleeve and center conductor.

Referring now to FIGS. 15 to 19, center conductor 32 is shown in greater detail. Center conductor 32 includes an axial opening 114 in first end 52 to engage a mating center conductor pin of a mating coaxial connector. Adjacent opening 114 is a tab 116 which is shown in FIGS. 15 and 16 deflected inward to more positively engage the mating center conductor pin and deflect outward when the mating pin is inserted within opening 114. A cylindrical housing 115 defines substantially the remainder of opening 114.

Extending away from opening 114 is a shaft 118 extending toward second end 54. In a portion of shaft 118 adjacent housing 115 is a seating ring 122 defining a seating ledge 124. A taper 130 provides a transition between seating ledge 124 and shaft 118. When center conductor 32 is inserted within opening 96 of center conductor insulator 48, seating ledge 124 engages outer surface 99 of central shaft portion 94 and taper 130 is positioned within taper 112. A pair of reverse tapered ledges 120 are positioned along shaft 118 between seating ledge 124 and second end 54, and are located so that they will be within opening 96 of center conductor insulator 48 when ledge 124 engages outer surface 99. The reverse taper of ledges 120 permits insertion of center conductor 32 within opening 94 of center conductor insulator 48 through taper 112 while resisting extraction in the opposite direction.

Second end 54 includes an axial opening 126 and a pair of opposing extensions 128 forming a slot 132. Slot 132 and opening 126 provide a secure location for forming electrical split 44 and structure to aid the physical and electrical connection of center conductor wires from cables 20 and 22 with center conductor 32.

Center conductor 32 may be constructed without the several features noted above for engaging center conductor insulator 48. A friction fit or other method or structure for securely holding the center conductor within center conductor insulator may be utilized.

FIGS. 20 to 25 show protective bushing 46, which fits about body 44 and closes sides 82 of opening 56. Bushing 46 includes a cylindrical body 134 within a first end 136 and a second end 138, and defines a central cavity 140. First end 136 includes an opening 142 into cavity 140 and second end 138 includes an opening 146 into cavity 140. To position bushing 46 about body 44, as shown in FIG. 1, above, conductive outer shell 26 is inserted through opening 146 into cavity 140 and out opening 142. A pair of opposing lobes 144 of opening 142 permit passage of bayonets 58 through bushing 46. Alternatively, opening 142 may be made large enough for passage of bayonets 58. Second end 138 is then positioned about a crimp ring 132 (shown in FIGS. 5 to 9, above), adjacent second wall 68 of opening 56. Second end 138 includes a pair of opposing crimp wings 148, separated by a pair of notches 150, to permit attaching by crimping to crimp ring 132 to secure bushing 46 to body 44.

When bushing 46 is inserted about body 44, an inner wall 152 within cavity 140 adjacent opening 142 through first end 136 is positioned adjacent a ledge 133 (shown in FIGS. 5 to 8, above), with conductive outer shell 26 extending through opening 142. With bushing 46 secured about crimp ring 132, inner wall 152 and ledge 133 cooperate to prevent entry into opening 56 of undesired objects or debris. Notches 150 are provided to permit easier crimping of bushing 46 about crimp ring 132 and permit extension of outer wall 76 beyond the limits of crimp ring 132 without adversely affected connection of bushing 46 to body 44. In addition, body 44 includes a pair of tabs 145 (shown in FIGS. 5 to 8, above) extending transversely from outer wall 76 adjacent crimp extensions 72. Tabs 145 engage notches 150 to orient bushing 46 prior to crimping to body 44. As shown, bayonets 58 and tabs 145 of outer wall 76 are centered approximately ninety degrees from each other about body 44. Notches 150 and lobes 144 are similarly positioned with respect to each other on bushing 46. Other orientations and positions of these features may be used within the bounds of the splitter herein described.

FIG. 26 shows a closer side view of opening 56 of splitter 10 with bushing 46 removed. Cable center conductors 34 and 36, each within an insulative jacket sheath 156, extend into opening 56 through an opening 70 for each of cables 20 and 22. Note that an outer coaxial or shield conductor of each cable 20 and 22 is terminated at crimp extension 72 and held to crimp extension 72 by crimp sleeve 50. The outer coaxial conductor of each cable 20 and 22 is electrically connected to crimp extension 72 and through body 44 to conductive outer shell 26 of first end 12. These outer coaxial conductors of cables 20 and 22 form a portion of common ground 24, as shown in the schematic diagram of FIG. 2. An outer jacket sheath 155 surrounds the outer coaxial conductor of cable 20 and 22 and is indicated in FIG. 1.

Within opening 56, cable center conductors 34 and 36 are entwined with each other to electrically connect to each other and positioned within slot 126 between extensions 128 of second end 54 of center conductor 32. This forms electrical split 40. Cable center conductors 34 and 36 can be held together by physical means or may also be soldered together to enhance the electrical connection as well as the physical connection. Alternative methods of physically and electrically joining cable center conductors 34 and 36 with second end 54 are within the bounds of the splitter described herein.

FIGS. 27 to 31 show a coaxial cable connector 160 such as used for output coaxial connectors 14 and 16. Connector 160 is mounted to and terminates cables 20 and 22 at an end opposite from crimp extension 70. Connector 160 includes a rotating outer sleeve 162 for releasably locking connector 160 to a mating coaxial connector. Rotating sleeve 162 is rotatably mounted about a conductive connector housing 164 within which is a center conductor 166. Center conductor 166 is mounted within and electrically isolated from housing 164 by a center conductor insulator 168. Center conductor insulator 168 is mounted within an opening 182 of housing 164 and positions a first end 186 of center conductor 166 within a first open end 183 of housing 164. A second end 188 of center conductor 166 is positioned within opening 182 adjacent a second end 184 of housing 164.

Rotating sleeve 162 is mounted to housing 164 about a shoulder 174. A washer 176 is positioned against an inner wall 190 within sleeve 162 and sleeve 162 is placed about shoulder 174. A wave washer 178 is positioned on an opposite side of shoulder 174 from washer 176 and a crimp washer 180 is positioned on the opposite side of wave washer 178. Crimp washer 180 is positioned within a second end 172 of sleeve 162 and second end 172 is crimped about crimp washer 180 to hold sleeve 162 and washers 176, 178 and 180 to housing 164. When so assembled, first end 183 of housing 164, a first end 170 of sleeve 162 and first end 186 of center conductor 166 are positioned adjacent one another to physically and electrically connect with a mating coaxial connector.

A second end 184 of housing 164 is configured to receive a crimp sleeve to allow a coaxial cable to be terminated and connected to connector 160. Such termination and mounting of connectors such as connector 160 to a coaxial cable are well known in the telecommunications industry. A crimp sleeve 187 is sized and configured to be placed about second end 184 and an outer insulative sheath and an outer coaxial conductor of a coaxial cable. The outer coaxial conductor is placed in electrical contact with housing 162 and thus to first end 183 of housing 162. Crimp sleeve 187 is crimped about the outer conductor and second end 184 to secure connector 160 to the coaxial cable.

FIGS. 32 to 35 show center conductor 166 of connector 160 including a shaft 192 extending between first end 186 and second end 188. Intermediate between the first and second ends is an annular recess 194 which cooperates with a first end 200 of center conductor insulator 168 to securely hold center conductor 166 within housing 164. Proximate second end 188 is a shoulder 196 which engages a rear surface 198 of insulator 168 (see FIG. 29. The engagement of shoulder 196 with rear surface 198 and the engagement of first end 200 with recess 194. Extending axially partially through center conductor 166 into second end 188 is an opening 202. Opening 202 permits a center coaxial conductor from the coaxial cable to be inserted to make electrical contact with center conductor of connector 160 during termination of the cable and mounting of connector 160 to the cable.

Coaxial cable and coaxial cable connectors are well known in the telecommunications industry. It is to be understood that different styles, formats and genders of such connectors can be substituted for the connectors and ends of connectors described and shown above, with straying from the bounds of the present invention.

What is claimed is:

1. A coaxial cable signal splitter comprising:

a first connector end, a second connector end and a third connector end, each connector end adapted to mate with and electrically connect to a mating coaxial connector;

each connector end including a center conductor mounted within a coaxially arranged conductive outer shell conductor;

a splitter body connected to the second and third connector ends by a pair of flexible coaxial cables, the splitter body further connected to the first connector end;

the splitter body including a cable mounting arrangement opposite the first connector end for connecting the pair of coaxial cables to the splitter body;

the splitter body including a transverse opening between the first connector end and the cable mounting arrangement, the transverse opening extending through the splitter body and having opposing open sides;

wherein, within the transverse opening, the center conductor of the first connector end is electrically connected with the center conductors of the second and third connector ends.

2. The coaxial cable signal splitter of claim 1, wherein the first connector end is integral with the splitter body.

3. The coaxial cable signal splitter of claim 1, wherein the center conductor of the first connector end includes a first end and a second end, the first end of the center conductor of the first connector end extending within the conductive outer shell of the first connector end and the second end of the center conductor of the first connector end extending within the transverse opening of the splitter body.

4. The coaxial cable signal splitter of claim 1, wherein the center conductor of each of the pair of coaxial cables extends within the transverse opening of the splitter body and electrically connects to the second end of the center conductor of the first connector end.

5. The coaxial cable signal splitter of claim 1, wherein each of the conductive outer shell conductors electrically connects to the other conductive outer shells.

6. The coaxial cable signal splitter of claim 1, wherein the arrangement for connecting the pair of coaxial cables to the splitter body includes a pair of crimp extensions extending from the splitter body opposite the first connector end, and a coaxially arranged conductor of each of the pair of cables is crimped and electrically connected to one of the crimp extensions.

7. The coaxial cable signal splitter of claim 1, wherein the first connector end of the splitter body includes a female coaxial connector.

8. The coaxial cable signal splitter of claim 1, wherein the second connector end includes a male coaxial connector.

9. The coaxial cable signal splitter of claim 1, wherein the third connector end includes a male coaxial connector.

10. The coaxial cable signal splitter of claim 1, wherein the splitter body is formed as a solid block and the transverse opening is machined through the splitter body.

11. A coaxial cable splitter body comprising:

a first end connected to an electrically conductive outer shell of a coaxial cable connector;

a opposite second end including a pair of electrically conductive crimp extensions for mounting a pair of coaxial cables;

a central opening extending transversely between open sides through the splitter body and positioned between the first and second ends, the first and second ends connected only by a pair of side walls on either side of the central opening, the side walls electrically connecting the outer shell and the crimp extensions;

the first end including an opening extending between the outer shell into the central opening and sized to receive a center conductor mounted within a center conductor insulator;

each of the crimp extensions including an opening extending through the crimp extensions into the central opening, the openings of the crimp extensions sized to receive a center conductor of one of the coaxial cables electrically isolated from the body, each crimp extension also including a textured outer surface;

the central opening providing space for the center conductor of the first end to be electrically connected with the center conductors of the coaxial cables without electrically contacting the side walls.

12. The splitter body of claim 11, further comprising the center conductor within the center conductor insulator positioned within the opening of the first end, the pair of coaxial cables mounted to the crimp extensions of the second end with the center conductors extending into the central opening and electrically isolated from the crimp extensions, an inner end of the center conductor of the first end electrically connected with the two center conductors of the coaxial cables within the central opening.

13. The splitter body of claim 12, further comprising a coaxial cable connector terminating each of the pair of coaxial cables at ends of the coaxial cables opposite the crimp extensions.

14. The splitter body of claim 13, wherein the first end defines a first gender of a coaxial cable connector and the coaxial cable connectors of the coaxial cables each define a second mating gender.

15. The splitter body of claim 11, further comprising a bushing positioned about the side walls and closing off the central opening.

16. The splitter body of claim 15, wherein the bushing is crimped to the second end.

17. A coaxial cable signal splitter comprising:

a first connector end, a second connector end and a third connector end, each connector end adapted to mate with and electrically connect to a mating coaxial connector;

each connector end including a center conductor mounted within a coaxially arranged conductive outer shell conductor;

a splitter body including a central transverse opening extending through the splitter body and having opposing open sides;

wherein, within the transverse opening, the center conductor of the first connector end is electrically connected with the center conductors of the second and third connector ends.

18. The coaxial cable signal splitter of claim 17, wherein the first connector end is integral with the splitter body.

19. The coaxial cable signal splitter of claim 17, wherein the second connector end and the third connector end connect to the splitter body via a pair of flexible coaxial cables.

20. The coaxial cable signal splitter of claim 17, wherein the first connector end defines a first gender of a coaxial cable connector and the second and third connector ends each define a second mating gender.

* * * * *